United States Patent [19]

Pouyer

[11] Patent Number: 5,020,937

[45] **Date of Patent: * Jun. 4, 1991**

[54] METHOD AND APPARATUS FOR CONSTRUCTION OF PERDURABLE ARTIFICIAL ROADS

[76] Inventor: Joseph E. Pouyer, 503 Martin Rd., Houston, Tex. 77018

[ * ] Notice: The portion of the term of this patent subsequent to Dec. 26, 2006 has been disclaimed.

[21] Appl. No.: 424,392

[22] Filed: Oct. 20, 1989

Related U.S. Application Data

[63] Continuation-in-part of Ser. No. 195,371, May 12, 1988, Pat. No. 4,889,444, which is a continuation-in-part of Ser. No. 161,780, Feb. 29, 1988, abandoned.

[51] Int. Cl.[5] ..... E01C 5/00

[52] U.S. Cl. ..... 404/35; 404/36

[58] Field of Search ..... 404/34–36, 404/40, 41, 45, 46; 52/581; 108/53.1, 53.3, 53.5, 57.1; 238/10 R

[56] References Cited

U.S. PATENT DOCUMENTS

| | | | |
|---|---|---|---|
| 1,970,037 | 8/1934 | Fischer | 404/46 X |
| 2,450,432 | 10/1948 | Lehrman | 108/57.1 |
| 2,639,650 | 5/1953 | Robishaw | 404/35 |
| 2,652,753 | 9/1953 | Smith | 404/41 |
| 2,819,026 | 1/1958 | Leyendecker | 404/41 X |
| 2,912,909 | 11/1959 | Hart | 404/36 |
| 2,950,078 | 8/1960 | Phillips | 108/53.1 |
| 3,855,945 | 12/1974 | Sebilleau et al. | 108/57.1 |
| 4,184,435 | 1/1980 | Shevchenko | 108/57.1 |
| 4,289,420 | 9/1981 | Davis et al. | 52/581 X |
| 4,462,712 | 7/1984 | Penland, Sr. | 404/46 X |
| 4,600,336 | 7/1986 | Waller, Jr. | 404/46 X |
| 4,600,337 | 7/1986 | Sarver | 404/46 X |

FOREIGN PATENT DOCUMENTS

| | | | |
|---|---|---|---|
| 154227 | 3/1982 | Fed. Rep. of Germany | 404/34 |
| 1579271 | 8/1969 | France | 404/34 |
| 996603 | 2/1983 | U.S.S.R. | 404/35 |
| 998686 | 2/1983 | U.S.S.R. | 404/35 |
| 1198139 | 12/1985 | U.S.S.R. | 404/35 |

*Primary Examiner*—Ramon S. Britts
*Assistant Examiner*—Gay Ann Spahn
*Attorney, Agent, or Firm*—Matthews & Associates

[57] ABSTRACT

A temporary road is provided which includes a plurality of sets each defined by a first and second matrices which include an upper surface for supporting heavy vehicles and the like over rough or impassable terrain and a second matrices which comprises support members for the upper or first matrices. Thus, one set is laid down such that the first matrices is in a top or upper position and cross members of the second matrices support the top member or upper matrices and thereafter a second set is positioned such that the first matrices is on the ground or in mud or the impassable surface is such that the second matrices or bottom of the second set with its spaced cross-support members interlocks with the spaced cross-support members of the first set and thereafter each set is interlocked such that the first, third, and fifth et sequence provide the upper surface of the road and the second, fourth and sixth et sequence sets provide the support for the upper sets. In this way the road can be constructed longitudinally and/or laterally and can further be constructed so that such road may expand laterally for working areas and the like. In the preferred embodiment the road is constructed of wood but it also may be constructed of other suitable, lighter and stronger fibers or combinations of fibers, if desired.

20 Claims, 2 Drawing Sheets

METHOD AND APPARATUS FOR CONSTRUCTION OF PERDURABLE ARTIFICIAL ROADS

This application is a continuation-in-part of copending application Ser. No. 195,371 filed May 12, 1988, which is a continuation-in-part of application Ser. No. 161,780 filed Feb. 29, 1988, now abandoned.

BACKGROUND OF THE INVENTION

This invention relates to a new and improved method and apparatus for the construction of artificial roads. In the drilling of oil wells or in the search for hydrocarbons or in construction or repairing of different type devices in remote areas it is very difficult to enable trucks and other heavy equipment to transport the necessary apparatus and equipment to the desired site because of poor ground conditions, for example, if the ground is too wet such trucks and the like cannot traverse a wet ground because they will become stuck. To overcome this problem a complete service industry has grown up which is either a complete temporary road construction crew which will lay down gravel, shale, or the like or board construction crews which will lay down as roads, a whole series of boards. Normally, to construct such a road the boards are anywhere from 10 ft. to 20 ft. long and anywhere from 1½ to 2½ inches thick and from 6 to 8 inches wide and thus not only are very heavy but also require manual manipulation in the form of labor to construct such boards laterally to a width of 8 ft. to 14 ft. and longitudinally sometimes for miles.

Further, while such boards, when laid down, will support heavy trucks, tractors, trailers and other equipment, because of the expense involved yet another labor intensive crew must move back in and, !f possible, separate such boards or pull such boards apart. Pulling such boards apart is often difficult because such boards are normally nailed with big heavy penny nails hammered into the boards with axes or sledge hammers.

Thus, such board road construction is not only very labor intensive but is also very dangerous because of the weight and build of the boards and it is also very capital intensive because of the number of board feet involved. Further, it is often difficult to remove such boards, if at all, more than one time and because such boards must be singularly torn apart and grouped together the usable life of such boards is not great when compared to the use/cost involved.

SUMMARY OF THE INVENTION

The purpose of the present invention is to attempt to provide a remedy for the construction of such board roads by providing a prefabricated mat system wherein the board roads not only do not have to be nailed together in the field but ar also interlocked such they will not be nailed together and further such board mats can be laid down in interlocking relationship in a much quicker and more economical period of time thus saving labor costs in the laying and dismantling of such board roads.

In addition such board roads may also be expanded or contracted such that the road may be expanded laterally with respect to the width of the artificial road and it is to be understood that such interlocking relationship relative to the matrix system is such that the matrices and matting system may be expanded radially relative to a center area for turnarounds or other working operations that is desired.

DESCRIPTION OF THE PREFERRED EMBODIMENT

Figure 1:
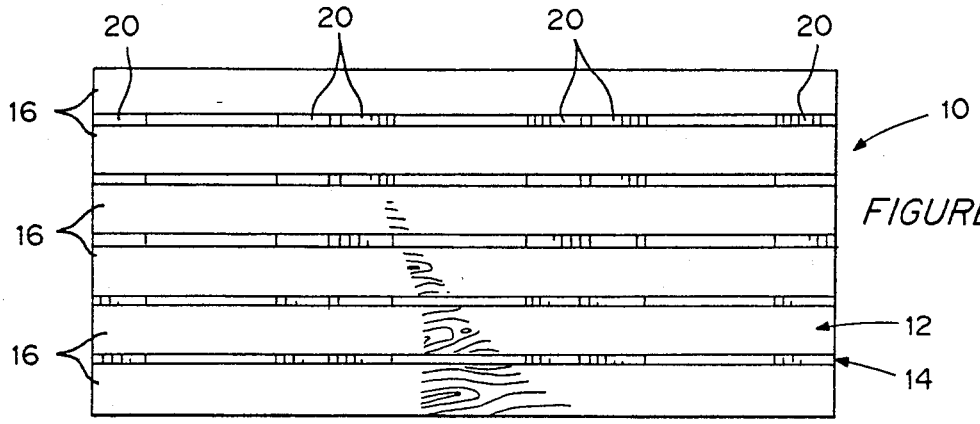
FIG. 1 is a top plan view of one section of the artificial road of the invention.

FIGS. 1–4 set forth in detail one embodiment of the present invention which includes and comprises, as set forth in FIG. 1, a set of 10 boards which comprise an upper matrices generally designated at 12 and a lower matrices generally designated at 14. The upper matrices 12 generally comprises a plurality of boards 16 spaced and of sufficient weight, width and length to support heavy equipment and vehicles because, as set forth hereinabove, such road is positioned and laid down over impassable terrain by such heavy equipment and vehicles. As further set forth in FIGS. 1 and 2, the second or lower matrices 14 is comprised of a plurality of cross-support members 20 for supporting each of the longitudinal members 16. As set forth in FIG. 2 each of the cross support members 20 include at least one or more cross pieces and, as further illustrated, may have more than one cross piece. As further illustrated, each of the cross support members of the second matrices are spaced relative to each other in a manner and for a reason to be set forth in more detail hereinbelow.

Figure 3:
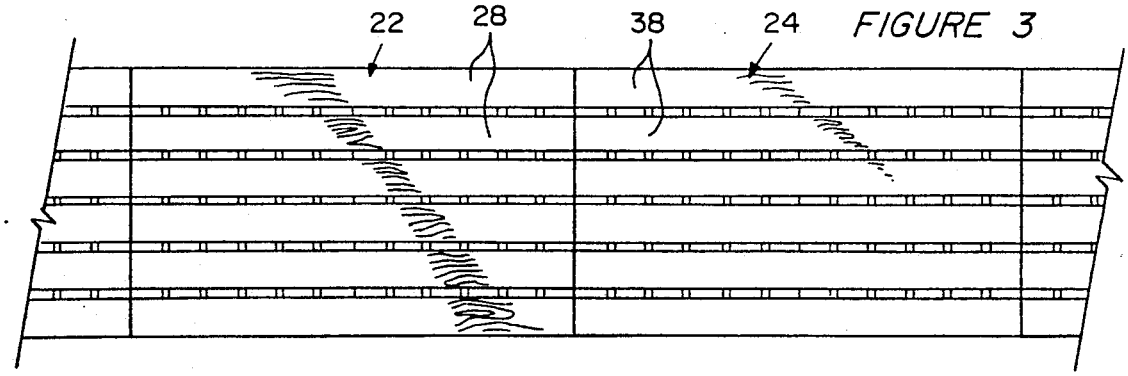
FIG. 3 is a plan view of a series of interlocked sections of this artificial road of the present invention.
Figure 4:
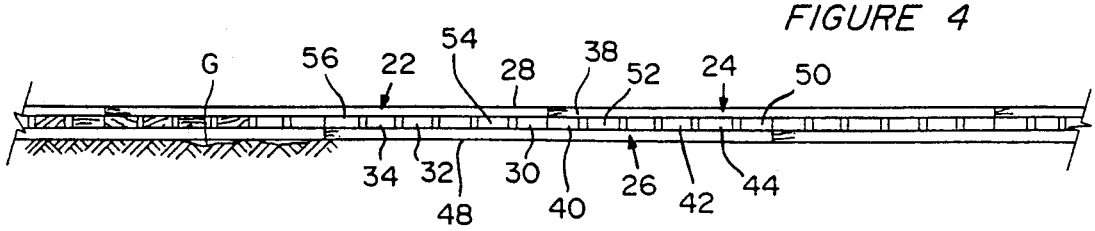
FIG. 4 is a side elevation of a series of interlocked sections of the artificial road of the present invention.

As further illustrated in FIGS. 3 and 4, the method of constructing the temporary road is set forth and generally illustrated by having a first set 22 longitudinally abutting a second set 24 and interlocked by a third set 26. As illustrated, the first set 22 comprises a plurality of longitudinally spaced board members 28 comprising the upper first matrix and a lower surface or second matrix comprising spaced cross pieces 30, 32 and 34. Similarly the second set 24 comprises the first or upper matrices comprising cross pieces 38 for the first or upper matrices and suitable spaced cross pieces 40, 42 and 44. It is to be understood that the second matrices of each of the first and second sets 22 and 24 comprises further and additional cross pieces which interlock with other sets to form the road.

The temporary road further comprises the third set 26 which comprises a first matrices 48 of spaced longitudinally positioned cross pieces and a second matrices which comprises cross pieces for supporting the first matrices which are spaced relative to each other such as illustrated at 50, 52, 54 and 56. As illustrated in FIGS. 3 and 4 and in operation the second set is positioned such that the first matrices cross pieces 26 are laid on the ground G with the second matrices positioned upwardly with the second matrices cross pieces 50 et.

sequence being supported and positioned transverse to the first matrices. Thereafter, the first and third sets are laid such that the cross piece 30 and the cross piece 40 of sets 22 and 24 are positioned adjacent each other and adjacent the cross pieces 20 (FIG. 4) of the second matrices of the second set so that such pieces interlock with each other such that any pulling or tugging of the board road in the longitudinal direction of the first matrices of each of such sets will be prevented so that the board road will not separate. In this manner, such temporary board road has a triple stack or set of boards with the second matrices of each of said sets being interlocked relative to each other and with the first matrices of each of said sets either being on the upper or lower surface and being positioned parallel to each other for laying out of the board road and longitudinal directions as desired. It should especially be noted that by providing such interlocking triple stacks both the upper and lower surfaces are comprised of uninterrupted runs of longitudinal boards, each section in the series abuts the adjacent section(s) with no intermediate gaps. This provides a more even transfer of the load from equipment using the road to the surface of the soil. A more even weight distribution over the soil results, this is especially desired in the areas with poor ground conditions where temporary road structures are needed.

Figure 2:
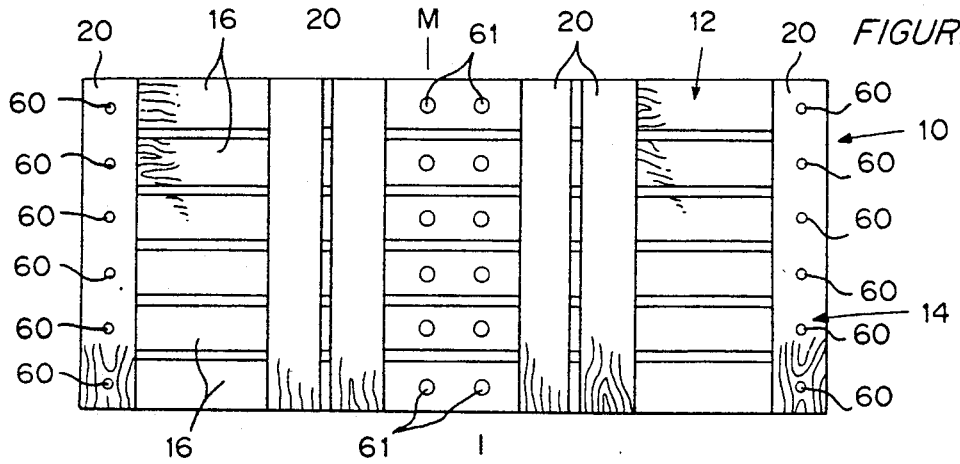
FIG. 2 is a bottom plan view of the artificial road of the present invention.

As illustrated in the primary embodiment depicted in FIGS. 1–4, under some conditions it might be desirable to provide secondary devices for interconnecting the mats. Therefore, although the primary interlocking would be provided by the previously described positioning of cross pieces 40 of sets 22 and 24 adjacent each other and adjacent the cross-pieces 20 (FIG. 4) of the second set, an auxiliary interlocking positioning a guide can be provided by equipping each set 10 with posts 60 and cups 61 which correspond and connect with cups 61 and posts 60 of any other set when sets are correctly positioned and assembled into the road as previously described. FIG. 2. Many different configurations could be devised. One example would place posts 60 along the midline underside of the two outer cross-support members 20 depicted in FIG. 2, that is the extreme left and right members. Corresponding cups would be positioned within the underside of the upper boards 16 of FIG. 2. The cups would be placed to align with posts of a similarly equipped set, that is at proper locations just off of the midline M of the set, parallel to the cross-support members 20. Each set would be identically equipped with such cups and posts and therefore each set could interchangedly be positioned to interlock with the cups and posts of other sets. Although only one arrangement has been described, any other arrangement that provides for interchangeable interlocking sets may be used. In addition, the posts and cups could be provided with a bayonet type locking device to further secure the sets together. An alternative to the bayonet type device could be cable securing devices for further securing the sets connected together.

Figure 5:
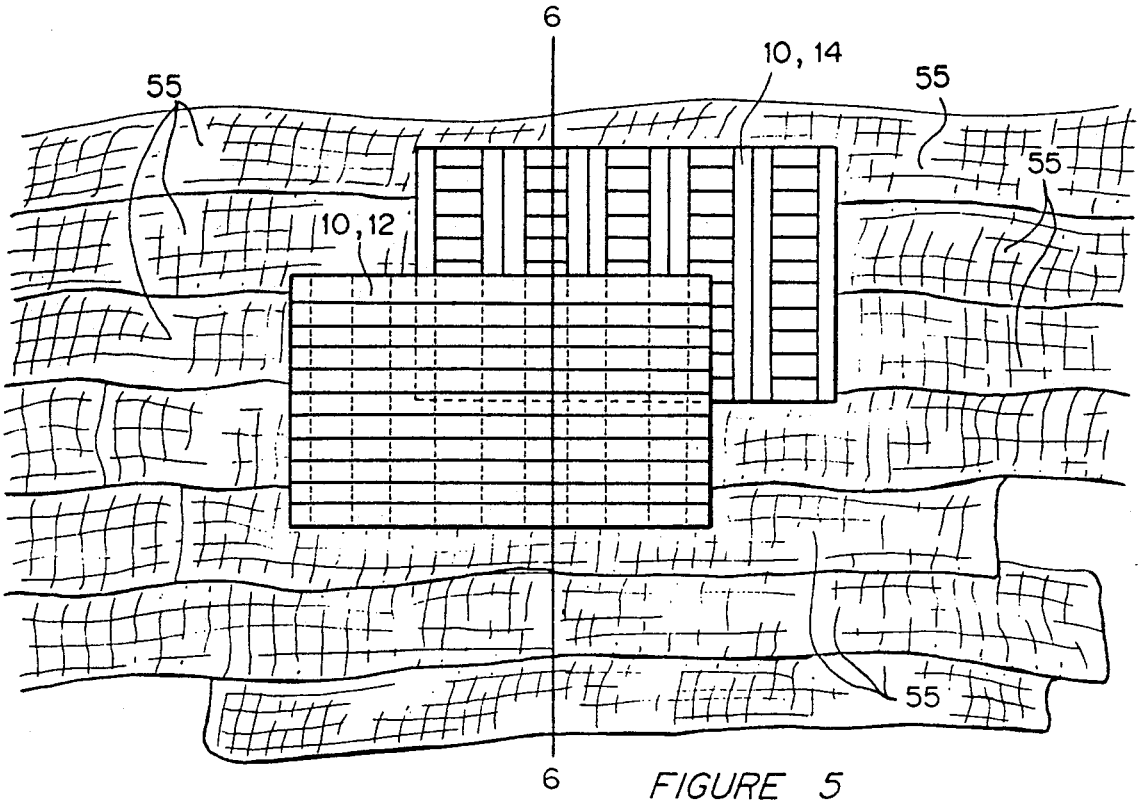
FIG. 5 is a plan view of portions of an alternative embodiment.
Figure 6:
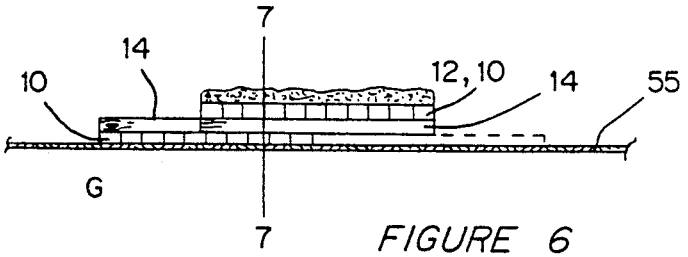
FIG. 6 is a cross section through the embodiment of FIG. 5.
Figure 7:
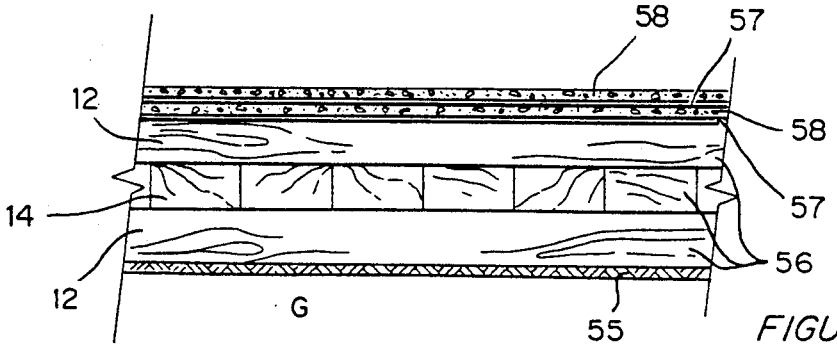
FIG. 7 is an enlarged cross section through the embodiment of FIG. 6.

Referring now particularly to FIGS. 5, 6, and 7 there is illustrated the primary enabling embodiment of a variation on the previously described invention. This variation comprises a system and perdurable coating for application to the sets of board roads described above which can be used in further combination with various types of protective membranes for interposition between the matrices sets and the ground. It should be understood that although the following description will feature the board road units of sets of matrices previously described, this permatizing system is equally applicable to other types of mats or loose lumber road ways and sites.

FIG. 5 illustrates the interlocking sets of board roads described above so that FIG. 5 in part illustrates the interlocking sets 10 of board roads described above. For greater clarity in understanding this specific embodiment it should be appreciated that other sets would be utilized in the embodiment, although only two are shown here. Each of the sets denominated 10, 12 would overlie a portion of four of the sets denominated as 10, 14.

If any site preparation is in order, or allowed, the first step would be to prepare the site by grading and leveling, or as otherwise appropriate. In many situations however environmental considerations might require that no such disturbance to the site is allowed. In either case, the following steps of this system and the following components of the apparatus would be equally appropriate.

A protective membrane 55 is laid down for interposition between the ground G and the lower mat. These membranes may be laid down in overlapping rolls longitudinally as illustrated in FIG. 5 so that there are no gaps. There are many types of such woven mats and geo textiles on the market, and the particular material used can be varied to suit requirements of any particular job. One suitable membrane would comprise a non-woven polypropelyne fabric. A trade example is PETRO MAT, which is manufactured by Phillips Petroleum. This fabric is a needle punched, non-woven polypropelyne fabric. The general roll is up to one hundred and twenty yards long, standard widths are seventy-five and one hundred and fifty inches, although other widths are available upon special order. This fabric is water proof, will not rot, and is not attacked by most chemicals. Further, it has a random fiber orientation which imparts multi directional properties of elongation and tensile strength to resist tear and puncture during the road construction, and throughout the roadway life. This or a similar membrane makes for faster and easier site clean up, and in delicate environments helps minimize disturbance to the site. helps minimize disturbance to the site.

Following the installation and placement of the geo textile membrane 55 the interlocking sets of mats are placed as has been previously described. The result as illustrated in FIGS. 5 and 6 is a layer of geo textile on top of the ground, which is topped by a triple stack of timber. This combination is next provided with the perdurable topping.

The perdurable topping is illustrated in FIGS. 6 and 7. The perdurable system consists of coating the interlocked board road units with a coating with suitable adhesion properties, both to the lumber and to the final surfacing material chosen. A particular embodiment would be placed on the underlayment of nonwoven geo textile 55 described above to provide an interlocked three board ply intermediate layer 56, FIG. 7. This intermediate layer would be hot asphalt coated 57 with an asphalt containing polymer. While the asphalt is hot one half inch sized crushed limestone or other suitable filler 58 in the range of near single size one-half inch wearing course type stone is applied. This rock course 58 would be swept and rolled into final position and then the steps of asphalting and coating with a layer of one-half inch stone is repeated. The asphalt may be AC-10P asphalt as described in the Texas Department of Highway and Public Transportation, Item 300. This is an asphalt modified with a three percent (3%) SBS (Styrene-Butadiene-Styrene) which is a polymer that adds cohesive and adhesive properties to the asphalt, to improve the flexibility and resiliency of the rough and remote terrain and will last much longer under heavy service conditions than a non permatized board road without topping.

Although a specific embodiment has been described with particularity as to the components of the system which comprise a particular arrangement of a specific geogrid textile, a particular arrangement of the previously described interlocking board mat units, and specific examples of asphalt mix and rock should be understood that the specifics are for illustrative purposes and not by way of a limitation of the invention, and that numerous variations and alternatives would suggest themselves to those of skill in the art when the scope and spirit of the invention described is considered for application to a particular field situation.

It is to be understood that while such sets have been depicted as being rectangular, that such may be square or radially constructed for radial expansion or may comprise further additions for expanding the road laterally, if desired without departing from the spirit of this invention.

It is to be further understood that while the invention specifically describes in its specific embodiment and enabling disclosure as being constructed of wood boards, that such matrices interlocking road system may be constructed of other type fibers or combination of fibers such as polyurethane, fiberglass, and the like.

It is to be further understood that, as previously mentioned, and in accordance with the spirit of the invention, mentioned, and in accordance with the spirit of the invention, such sets may be constructed with alternate dimensions and materials for varying applications. The sets could be constructed by way of example and not by way of limitation, of metal or metal alloy, solid or expanded, or a combination of solid channels and expanded metal. Additionally, applications might best be fitted with sets constructed of fiberglass components, or plastic, or rubber, or a combination of these materials.

In particular the components could be manufactured from ground up or pulverized, used automobile and truck tires. This material may be manipulated in a variety of ways to provide the desired strength and durability. The material can be combined with numerous bonding agents, consolidated, and pressed in a mold to form the desired configuration. This material could also be combined with other materials to form composite elements of the recycled tire material and longitudinal fibers in a process analogous to pultrusion for fiberglass or pre-stressing for precast concrete. Randomly placed shorter fibers can also be provided by simply adding them to the mix with the bonding agent prior to the consolidation and hardening. These random fibers can be added to vary the strength properties of the elements as needed. The curing can be done in a variety of ways, such as by heat, by chemical reaction, or by a combination.

The components of traverse and longitudinal elements can be specifically engineered by designing the composition and placing the stresses each element of the matrices set is subject to. High strength longitudinal fibers such as "Aramid" or Keular can be incorporated into fiberglass sets, as can components formed by a pultrusion process. Such longitudinal fibers or cables could also be used to tie the individual sets together longitudinally. As just discussed, correct placement of the longitudinal cables would add structural strength where needed and further hold sets together as a unit. Laminate composite wood sets can be substituted for the solid timber sets described in the preferred embodiment. Sets could be cast of high strength low density prestressed or post tensioned concrete elements. Elements of any of the above mentioned examples can be combined to meet the longevity, terrain, soil, cost, transportability, and reusability requirements of any particular job requiring a temporary road constructed from interlocking matrices.

While this invention has been described by means of a specific preferred embodiment and various alternative examples it is not to be limited thereto. Obvious modifications will occur to those skilled in the art without departing from the scope of the invention.

I claim:

1. A temporary decking system to facilitate transportation over poor soil and rough terrain conditions comprising a plurality of overlapping units placed in at least first and second horizontal layers vertically disposed relative to each other, each unit comprising inner and outer faces wherein:

(a) said outer faces comprise a first group of elements substantially longitudinally parallel;

(b) said inner faces comprise a second group of substantially parallel runner elements attached to said first group in spaced relation to one another and transverse to said first group, wherein said spaced relationship is such that said first and second transverse elements are disposed one near each end of each unit and the remaining transverse elements are positioned between said end transverse elements to present at least one interior ridge and so as to define at least two channels between said end transverse elements wherein each channel and each interior ridge is of greater width than said end transverse elements so that transverse ridge elements of any one unit will conform to channels of any other inverted unit, and when units are so interconnected during installation will substantially prevent longitudinal movement of any unit relative to adjacent units; and, (c) wherein said first layer comprises a plurality of units arranged in end to end relationship with the outer faces down and wherein said second layer comprises a layer of units arranged in end to end relationship with outer faces up and arranged so that each unit in said upper layer overlaps at least one adjacent unit in the lower level, and so that each unit in the upper layer interlocks with at least two units in the lower layer by fitting said transverse runner elements of one unit into the transverse channels defined by the transverse runner elements of any other inverted opposed unit.

2. The invention of claim 1 further comprising a perdurable toping applied to the upper surface of the roadway.

3. The invention of claim 2 wherein said perdurable topping comprises at least one layer of asphalt topped with at least one layer of swept and rolled rock.

4. The invention of claim 3 wherein the asphalt is modified with a three percent (3%) Styrene-Butadiene-Styrene polymer, and wherein the rock is near single size one-half inch crushed limestone.

5. The invention to claim 2 further comprising a membrane underlayment of geo textile interposed between the ground and said sets of matrices.

6. The invention of claim 5 wherein said geo textile membrane comprises an non-woven polypropelyne needle punched fabric.

7. The invention of claim 1 further comprising a membrane underlayment of geo textile interposed between the ground and said sets of units.

8. The invention of claim 1 further comprising means for preventing lateral movement of any one unit relative to adjacent units.

9. The invention of claim 8 wherein the means for preventing lateral movement comprises a series of posts and cups wherein said cups conform to said posts so that when two units are inverted relative one to another and interconnected posts of one unit fit into the cuts of the opposing unit.

10. The invention of claim 1 wherein first and second transverse ridge elements are disposed each near one end of each bearing plate and the remaining transverse ridge elements are positioned between said end transverse elements to present at least one interior ridge and so as to define at least two grooves between said end transverse elements wherein each channel and each interior ridge is approximately twice the width of said end transverse ridge elements.

11. A temporary road for placing through on and in rough terrain for equipment and vehicles, said temporary road comprising:

(a) a plurality of sets each comprising first and second matrices;

(b) each of said sets being constructed such that said first matrices is the upper surface of said set comprising longitudinal elements and said second matrices is the lower surface of said set comprising spaced elements traverse to the longitudinal elements;

(c) each of said sets of matrices being constructed and laid down on such terrain such that up to a much as the first half of the second matrix of said first set interlocks with up to as much as the first half of the second matrix of the second set and such that the first half or more of the second matrix of the third set interlocks with the second half or more of the second matrix of the second set;

(d) said matrices set being assembled such that said first set is longitudinally aligned with said third set and said third set is longitudinally aligned with the fifth set and such that said second set interlocks said first and third set longitudinally only by having the second matrices of the first and third set face the second matrices of the second set et sequence;

(e) a perdurable topping applied to the upper surface of the roadway; and, (f) wherein assembly of said sets as set forth hereinabove, constructs a temporary road which is easily positioned and which also may be easily removed and stored for reuse as desired.

12. The invention of claim 11 wherein said perdurable topping comprises at least one layer of asphalt topped with at least one layer of swept and rolled rock.

13. The invention of claim 12 wherein the asphalt is modified with a three percent (3%) Styrene-Butadiene-Styrene polymer, and wherein the rock is near single size one-half inch crushed limestone.

14. The invention of claim 11 further comprising a membrane underlayment of geo textile interposed between the ground and said sets of units.

15. The invention of claim 14 wherein said geo textile membrane comprises an non-woven polypropelyne needle punched fabric.

16. A temporary road for placing through on and in rough terrain for equipment and vehicles, said temporary road comprising:

(a) a plurality of like sets each comprising first and second matrices;

(b) each of said sets being constructed such that said first matrices is the upper surface of said set comprising longitudinal elements and said second matrices is the lower surface of said set comprising spaced elements traverse to the longitudinal elements;

(c) each of said sets of matrices being constructed and laid down on such terrain such that up to as much as the first half of the second matrix of said first set interlocks with up to as much as the first half of the second matrix of the second set and such that the first half or more of the second matrix of the third set interlocks with the second half or more of the second matrix of the second set;

(d) said matrices sets being assembled such that said first set is longitudinally aligned with said third set and said third set is longitudinally aligned with the fifth set and such that said second set interlocks said first and third set longitudinally only by having the second matrices of the first and third set face the second matrices of the second set et sequence;

(e) a membrane underlayment of geo textile interposed between the ground and said sets of matrices; and, (f) whereas assembly of said sets as set forth hereinabove, constructs a temporary road which is easily positioned and which also may be easily removed and stored for reuse as desired.

17. A method of constructing a temporary road comprising:

(a) installing an underlayment geo textile membrane on the surface of the ground;

(b) the steps of assembling a plurality of like sets each comprising first and second matrices wherein each of said sets is formed by having a first surface matrices comprising longitudinal elements for facing the ground and for supporting vehicles and the like and a second matrices comprising inner surfaces which provide spaced connecting cross members for said first matrices of each set in which interlocks opposed sets that are inverted relative to one another;

(c) laying each of said sets down such that in laying a first set down the first matrices of said first set is on the upper traveling surface and such that in laying down a second st the first matrices of the second set is laying on the ground for interlocking the cross-members of the second matrices of the first set up to the cross-members of the second matrices of the second set and thereafter laying down the third set such that the first matrices of said third set is positioned upwardly and such that the second matrices of the third set interlocks longitudinally only with the second matrices of the second set; and, (d) thereafter interlocking alternate sets as set forth in (c) for the construction of a board road as desired in both longitudinal and lateral direction if desired.

18. The invention of claim 17 further comprising the steps of laying down at least one layer of asphalt followed by a layer of swept and rolled rock.

19. A method of constructing a temporary road comprising:

(a) the steps of assembling a plurality of sets each comprising first and second matrices wherein each of said sets is formed by having a first surface matrices comprising longitudinal elements for facing the ground and for supporting vehicles and the like and a second matrices comprising inner surfaces which provide spaced connecting cross members for said first matrices of each set in which interlocks opposed sets that are inverted relative to one another;

(b) laying each of said sets down such that in laying a first set down the first matrices of said first set is on the upper traveling surface and such that in laying down a second set the first matrices of the second set is laying on the ground for interlocking the cross-members of the second matrices of the first set up to the cross-members of the second matrices of the second set and thereafter laying down the third set such that the first matrices of said third set is positioned upwardly and such that the second matrices of the third set interlocks longitudinally only with the second matrices of the second set;

(c) thereafter interlocking alternate sets as set forth in (b) for the construction of a board road as desired in both longitudinal and lateral direction if desired; and, (d) laying down at least one layer of asphalt followed by a layer of swept and rolled rock upon said traveling surface.

20. An interlocking mat system for the construction of temporary roadways, working areas and the like, comprising:

(a) an upper mat having a substantially planar upper face and having a plurality of spaced ridges including end ridges and interior ridges forming a lower face and defining spaced channels therebetween, two of said ridges being flush with respective ends of said upper mat, at least one of said interior ridges being of greater width than said end ridges; and, (b) a lower mat having a substantially planar lower face and having a plurality of spaced ridges forming the upper face thereof, said spaced ridges and channels of said lower face of said upper mat establishing complete interlocking relation with the spaced ridges and channels of said upper face of said lower mat when said upper and lower mats are placed in superposed assembly.

* * * * *